United States Patent [19]

Bisgaard et al.

[11] Patent Number: 4,545,491

[45] Date of Patent: Oct. 8, 1985

[54] FEEDING BOTTLE HAVING AN AIR INTAKE VALVE

[75] Inventors: Hans F. Bisgaard, Hasselager; Jörgen D. Jensen, Ny Solbjerg, both of Denmark

[73] Assignee: Jens C. Jensen, Ribe, Denmark

[21] Appl. No.: 503,150

[22] PCT Filed: Oct. 20, 1982

[86] PCT No.: PCT/DK82/00095

§ 371 Date: May 19, 1983

§ 102(e) Date: May 19, 1983

[87] PCT Pub. No.: WO83/01381

PCT Pub. Date: Apr. 28, 1983

[30] Foreign Application Priority Data

Oct. 21, 1981 [DK] Denmark ..... 4642/81

[51] Int. Cl.[4] ..... A61J 9/04

[52] U.S. Cl. ..... 215/11 D; 215/11 D; 215/11 B

[58] Field of Search ..... 215/11 B, 11 D, 11 R

[56] References Cited

U.S. PATENT DOCUMENTS

| | | | |
|---|---|---|---|
| 1,441,406 | 1/1923 | Dales | 215/11 B |
| 1,938,052 | 12/1933 | Speir | 215/11 B |
| 2,043,186 | 6/1936 | O'Dette | 215/11 B |
| 2,321,236 | 6/1943 | Parkin | 215/11 B X |
| 2,379,562 | 7/1945 | Boxley | 215/11 B |
| 2,394,722 | 2/1946 | Sloane | 215/11 B |
| 2,456,337 | 12/1948 | Soper | 215/11 B |

*Primary Examiner*—William Price
*Assistant Examiner*—Sue A. Weaver
*Attorney, Agent, or Firm*—Antonelli, Terry & Wands

[57] ABSTRACT

A feeding bottle (2) having a bottom cap (8) comprising an inverted cup shaped portion (10), which projects into the bottle and is surrounded by a stretched, resilient rubber sleeve (12) covering a radial hole (14) in the cylindric wall of the cup portion (10) to form an automatic air intake valve. The radial hole (14) is provided in a part-cylindric facet (16) of reduced cross section curvature, whereby even a gross rubber sleeve (12) is easily liftable from the hole (14) for sensitively admitting air into the bottle (2) whenever a moderate suction vacuum is built up therein.

5 Claims, 3 Drawing Figures

FIG.1
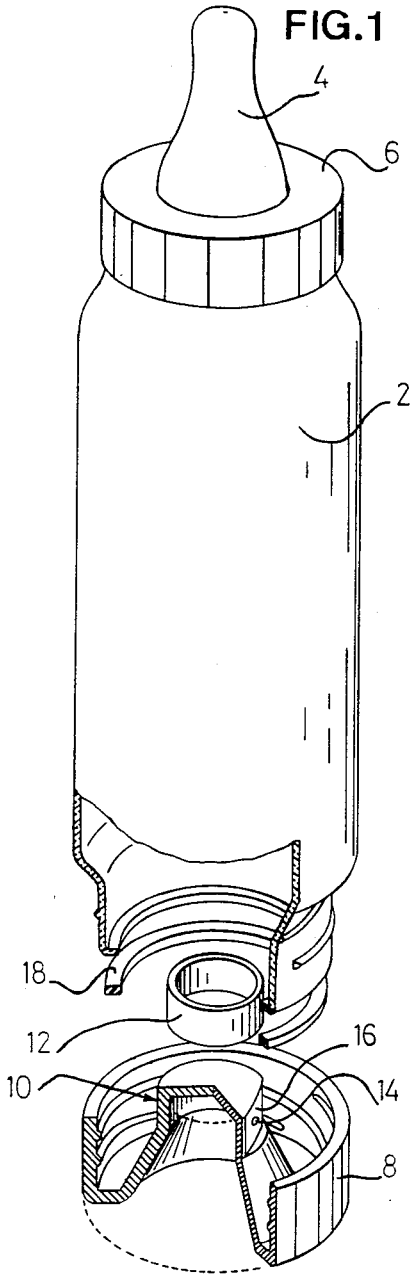
FIG. 2
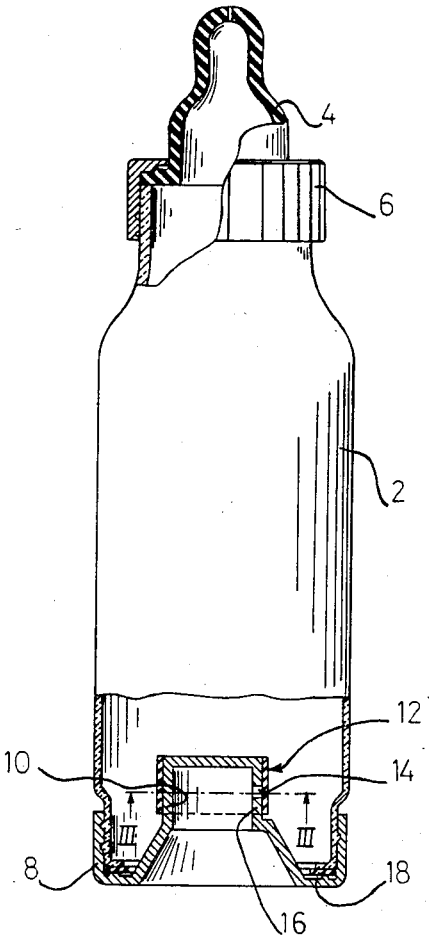
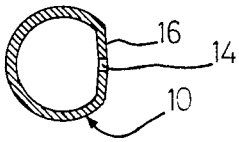
FIG. 3

FEEDING BOTTLE HAVING AN AIR INTAKE VALVE

The present invention relates to a feeding bottle.

It is a well known problem that ordinary feeding bottles give rise to the babies getting colic to a more or less pronounced degree, and at least care should be taken to make the babies burp from time to time during their sucking. The reason is that they tend to continue their sucking until a relatively high vacuum is produced in the bottle, whereby they cannot avoid sucking in false air from outside the bottle teat. Breast-fed babies are less liable to get colic, because the sucking does not create any increasing counter vacuum, and normally the necessary natural suction vacuum in the mouth of the baby does not cause any considerable intake of false air.

Principially it should seem easy to overcome the vacuum problem in connection with feeding bottles, since all what is necessary is to arrange for an air intake valve which is adjusted so as to admit air into the bottle whenever a moderate vacuum has been built up therein, whereby the baby may empty the bottle without at any time creating such a high vacuum as giving rise to the said false air intake. Correspondingly, several proposals for such a simple vacuum control function have already been made, but practice shows that they have obviously been inadequate, since they are practically unknown, despite the almost basal need for such a device.

The known proposals may be divided into two groups, one using manually operated air inlet valves and the other using automatic valves. The first group is generally uninteresting, because a manual valve will require the same high degree of attendance as otherwise required for causing a break in the sucking, by pulling out the teat from the baby's mouth every now and again for enabling the vacuum in the bottle to be steadily kept at a low level. It is of course the automatic valves which are of primary interest, and again it is worth noting that such valves have not found their way to practical use, even though automatic air intake valves are known in many varieties from various fields of the technique, generally.

However, as far as feeding bottles are concerned, it will be a major requirement that the details of the air intake valve should be cheap simple and robust and well suited to be separated for general cleaning and reassemblable by absolutely non-skilled persons, and at the same time the valve system shall be fully tight against leakage of milk and yet highly sensitive so as to react to the building up of a moderate vacuum in the feeding bottle with a reasonably high degree of accuracy.

A basic possibility of an intake valve design is to use a valve member of a rubber sheet material placed against an apertured rigid wall portion of the bottle, e.g. against the inside of a separate bottom closure cap, see the Danish Patent Specification No. 143,484 and the French Patent Specification No. 1,058,610. For tightly closing the valve against outflow of milk the rubber sheet shall have to be stretched so as to be tensioned against the wall, and when the rubber sheet, as desirable, is a robust and reasonably thick element it will be very difficult to provide for such fine tolerances that the tensioned sheet will open for air intake with the required accuracy as to the vacuum response.

More specifically the invention relates to a feeding bottle having a suction outlet and an air intake valve, which is located spaced from the suction outlet and comprises an interior resilient valve sheet member cooperating with an apertured rigid wall portion of the bottle so as to constitute a check valve operable to open for admission of air into the bottle in response to a predetermined vacuum occurring therein, and it is the purpose of the invention to provide such a bottle, which may show an accurate vacuum response and yet be of a robust design.

In accordance with the present invention, a feeding bottle is provided wherein the resilient valve sheet member is mounted or mountable so as to be generally stretched over a convex surface of the rigid wall portion in which an air inlet hole is provided in a sub-area thereof, the sheet engaged surface of which is of a smaller convexity than the adjacent or surrounding surface portions of the rigid wall portion. Thus, there is still used a resilient valve sheet member, which is caused to be stretched over a convex wall portion, but a sub area of of this portion around the air intake hole is less convex, i.e. more flat; hereby the pressure of the stretched sheet member against the rigid wall surface will be automatically reduced in the critical area about the air intake hole, and practice shows that, in this manner, a remarkably sensitive and accurate vacuum response is achievable even when the sheet member is a coarse element as suitable for repeated dismounting and remounting for cleaning purposes.

According to prior proposals it has been natural to combine the valve sheet member with the sealing ring member as required for sealing the said bottom cap member to the bottle, viz. by using a sheet disc member, the peripheral portion of which constitutes the said sealing ring. By experiments in connection with the invention, however, it has been found that at least when a screw cap is used, the screwing friction at the end of the mounting of the screw cap will cause twist stresses to occur in the sheet member, whereby the opening accuracy of the sheet member is compromized. It is a special preferred feature of the invention, therefore, that the sheet member, when used in connection with a separate bottom screw cap, is a separate member which is non-integral with the said sealing ring, whereby it should of course be fixable to the bottom cap in some suitable manner other than by being squeezed between the cap and the bottom hole edge of the bottle.

A preferred manner of arranging the valve sheet member on a separate cap member is to let it surround the outside of a cup shaped inner portion of the cap member, i.e. to use a cylindric valve sheet member or valve tubing mounted on a slightly wider rigid cylinder portion of the cap member, this being a highly advantageous design.

In the following the invention is described in more detail with reference to the accompanying drawing, in which:

FIG. 1 is a perspective exploded view of a feeding bottle according to the invention, FIG. 2 a sectional view of the bottle, and FIG. 3 is a cross sectional view of a central cup shaped portion of a bottom cap member of the bottle.

As shown in FIGS. 1 and 2, a feeding bottle 2 and is topwise provided with a teat 4 in a fully conventional manner, with the teat being releasably secured to the neck of the bottle by means of a screw member 6.

The bottle member has a bottom opening which is covered by a bottom screw cap 8 having a central inverted cup shaped portion 10 which projects into the bottle and is surrounded by a rubber sleeve 12. A radial hole 14 is provided in a portion 16 of the cylindrical wall of the cup shaped portion 10.

As shown in FIGS. 2 and 3 the wall portion 16, in which the hole 14 is provided, is an only slightly convex wall portion or facet of the otherwise circular and thus generally more convex outside of the cup shaped portion 10.

A sealing ring 18, which is disintegral with the rubber sleeve or valve tubing 12, provides for the required sealing between the bottom cap 8 and the edge of the lower opening of the bottle 2.

With the bottle 2 closed bottomwise as here described the bottle 2 may be filled fully conventionally through the top end thereof. Thereafter, the bottle 2 may be used initially as any known feeding bottle, in upside down position, but when the baby has caused a moderate vacuum to occur in the bottle the ambient air pressure will act through the hole 14 to lift the rubber sleeve 12 off its engagement with the facet 16 or a part thereof, the air thus finding its way into the bottle to prevent further vacuum build-up therein. Preferably the cup portion 10 is slightly conical, and when the sleeve 12 is non-conical the air will tend to enter the bottle adjacent the inner end of the cup portion 10 or rather the facet 16. Therefore, the baby will be able to continue the sucking without any need of intermediate stops for admitting air to the bottle through the teat 4 and without any considerable intake of false air due to overcritical vacuum in the bottle or rather in the mouth of the baby. Even if the bottle 2 is full the baby may comfortably suck it empty in a fully continuous manner.

Care should be taken, of course, that the rubber sleeve 12 is an "authorized" member having the necessary diameter and resiliency for—when stretched about the cup portion—defining or responding to the relevant maximum vacuum in the bottle. On the other hand, practice shows that the production of the rubber sleeves does not require any particularly fine tolerances, because a moderate change in the properties of the sleeves does not affect the opening pressure of the valve to a corresponding degree due to the presence of the almost flat facet 16.

It will be appreciated that the entire bottom closure and valve system is made of few and coarse elements which are easy to dismount for the necessary cleaning and easy to reassemble even for highly unskilled persons.

As mentioned, it is advantageous that the sleeve 12 is disintegral with the sealing ring 18, a.o. because the frictional engagement of the ring 18 at the end of the onscrewing of the bottom cap 8 could tend to produce stresses in the sleeve making its vacuum response less accurate, according to the degree of tightening of the cap 8. On the other hand it has been observed that the vacuum response of the valve is practically the same whether the sleeve 12 is mounted on the cup member 10 by a pure axial insertion or by a concurrent screwing motion, even if this motion is eased with an active finger tip located just outside the facet 16.

The invention is not restricted to the embodiment shown in the drawing. Thus, it would of course not be impossible to combine the sleeve 12 with the sealing ring 18. The valve should not necessarily be located at the bottom of the bottle 2, as it may operate even when located at an area which in use is underneath the level of the milk in the bottle. The stabilized and sensitive valve function due to the facet 16 may even be achievable in connection with a valve disc as according to the prior art, viz. when the resilient disc is stretched over a dome shaped support having a less domed facet portion at the sub area where the relevant valve holes are provided.

We claim:

1. A feeding bottle having a suction outlet and an air intake valve spaced from the suction outlet, said air intake valve including an interior resilient valve sheet member cooperating with an apertured rigid wall portion of the bottle so as to constitute a check valve operable to open for admission of air into the bottle in response to a predetermined vacuum occurring therein, characterized in that the resilient valve sheet member is mountable so as to be generally stretched over a convex surface of said rigid wall portion, an air inlet hole is provided in a sub area of said rigid wall portion, a surface of the sub area of the rigid wall portion is engaged by the sheet member and is of a smaller convexity than adjacent or surrounding surface portions of the rigid wall portion.

2. A feeding bottle according to claim 1, characterized in that the said rigid wall portion is constituted by a regular or slightly conical cylindrical portion having a partially cylindrical facet of reduced cross sectional curvature, in which the air intake hole is provided, the resilient sheet member being of a cylindrical shape and surrounding the cylindrical portion in a stretched manner.

3. A feeding bottle according to one of claims 1 or 2, in which the rigid wall portion forms a part of a screw cap member sealingly screwed onto the bottle and sealed by a sealing member, characterized in that the resilient valve sheet member is a separate member from said sealing member.

4. A feeding bottle according to claim 3, in which the air intake valve is arranged in connection with a bottom closure cap of the bottle, characterized in that the bottom closure cap has an inverted cup-shaped portion projecting into the bottle and serving as a core member for the resilient valve sheet member, which in its mounted condition is expanded so as to normally close the outer end of the air intake hole formed as a radial hole in said cup-shaped portion.

5. A feeding bottle according to claim 2, in which the air intake valve is arranged in connection with a bottom closure cap of the bottle, characterized in that the bottom closure cap has an inverted cup-shaped portion projecting into the bottle and serving as a core member for the resilient valve sheet member, which in its mounted condition is expanded so as to normally close at the outer end of the air intake hole formed as a radial hole in said cup-shaped portion.

* * * * *